US006059457A

United States Patent [19]

Sprehe et al.

[11] Patent Number: 6,059,457

[45] Date of Patent: May 9, 2000

[54] EVACUABLE STORAGE BAG WITH INTEGRAL ZIPPER SEAL

[75] Inventors: Gregory S. Sprehe, Carbondale; Lester D. Siebert, Cobden; Donald K. Wright, Murphysboro, all of Ill.

[73] Assignee: Com-Pac International, Inc., Carbondale, Ill.

[21] Appl. No.: 09/131,709

[22] Filed: Aug. 10, 1998

Related U.S. Application Data

[63] Continuation-in-part of application No. 09/002,517, Jan. 2, 1998, abandoned.

[51] Int. Cl.[7] ..... B65D 33/16; B65D 33/01

[52] U.S. Cl. ..... 383/63; 383/103; 206/524.8

[58] Field of Search ..... 383/63, 64, 65, 383/100, 103; 206/524.8

[56] References Cited

U.S. PATENT DOCUMENTS

| | | | |
|---|---|---|---|
| 2,772,712 | 12/1956 | Post | 383/65 |
| 2,789,609 | 4/1957 | Post | 383/65 |
| 3,325,084 | 6/1967 | Ausnit | 383/63 X |
| 4,532,652 | 7/1985 | Herrington | 383/63 X |
| 5,142,970 | 9/1992 | ErkenBrack | 383/63 X |
| 5,450,963 | 9/1995 | Caron | 206/524.8 |
| 5,655,273 | 8/1997 | Tomic et al. | 383/63 X |
| 5,829,884 | 11/1998 | Yeager | 383/63 X |
| 5,839,582 | 11/1998 | Strong et al. | 383/63 X |
| 5,881,881 | 3/1999 | Carrington | 206/524.8 |

FOREIGN PATENT DOCUMENTS

| | | | |
|---|---|---|---|
| 84853 | 3/1989 | Japan | 383/63 |
| 139351 | 5/1990 | Japan | 383/63 |
| 212355 | 9/1991 | Japan | 383/63 |
| 6227551 | 8/1994 | Japan | 383/100 |

*Primary Examiner*—Jes F. Pascua
*Attorney, Agent, or Firm*—Michael Best & Friedrich

[57] ABSTRACT

An evacuable storage container for holding compressible articles including a flexible, air-impermeable bag defining an interior and having first and second openings, a one-way valve mechanism sealingly positioned over the first opening, and configured to allow fluid to pass through the valve mechanism out of the bag and to substantially prevent fluid from entering the bag, and a zipper seal adjacent the second opening that is configured to substantially close the second opening. The zipper seal is integral with the bag and includes a first strip including at least one rib that extends from the surface of the first strip, and a second strip opposite the first strip, the second strip including at least two ribs that extend from the surface of the second strip and that are offset from the rib of the first strip such that the first and second strips may be sealingly engaged.

22 Claims, 1 Drawing Sheet

EVACUABLE STORAGE BAG WITH INTEGRAL ZIPPER SEAL

This application is a continuation in part of a U.S. patent application No. 09/002,517 filed Jan. 2, 1998 now abandoned.

FIELD OF THE INVENTION

The present invention generally relates to the field of evacuable collapsible containers for storing compressible articles, such as clothing, tea, spices and other hydroscopic materials, and more particularly to vacuum bags having integral zipper seals.

BACKGROUND OF THE INVENTION

A collapsible storage bag that can be relatively simply and easily evacuated and that effectively maintains the integrity of the vacuum has a variety of uses. A particularly useful application of such a bag is in storage and preservation of clothing. Compressing the clothing may significantly reduce the amount of space needed for storage. Also, clothing may be destroyed by exposure to the environment during long term storage. For example, various organisms such as moths or bacteria may ruin clothing. Limiting the air around the clothing may greatly help to preserve the clothing, because such organisms require oxygen to survive. Further, limiting the amount of moisture around the garment may inhibit the growth of mildew and additionally inhibit growth of destructive organisms.

An additional use of such a vacuum bag would be to store perishable food items. Tea, spices and other food items spoil or loose their flavor when exposed to air and moisture. In this respect, the user could control the climate of any hydroscopic material that could be stored in such a bag. Further, items compressed in a storage bag would have a reduced in volume and therefore could be stored with greater efficiency while maximizing storage space.

While similar containers exist, all current designs suffer from a number of shortcomings. For example, U.S. Pat. No. 5,203,458, issued to James T. Cornwell, discloses a disposable surgical garment container. The garment container includes a one way valve for air to be vacuumed from the container and an opening which may be permanently sealed. The garment is placed inside the bag and the seal is closed with the application of a heat source. Such a design is not reusable because the container must be permanently sealed. Thus, such a container is expensive and inconvenient for storage of clothing because a new storage bag must be used each time. Further, a new storage bag must be used if air leaks into the bag.

U.S. Pat. No. 5,480,030, issued to Sweeney et al., discloses a reusable evacuable enclosure for storage of clothing and the like. A polyethylene bag forms the body of the container, and a one way valve is installed in the surface of the bag to permit the bag to be evacuated. The bag includes an opening for inserting items into the bag, and the opening may be held closed by a hinged seal. However, such a design requires an additional component, the seal, that may be lost or broken. Also, the external seal pinches or crimps the bag, and may wear the bag and limit the reusability. Lastly, the external seal may not maintain the seal effectively over a longer time period.

All prior art designs that provide a reusable container suffer from similar shortcomings. Generally, they either are not reusable or, if they are reusable, do not effectively maintain the integrity of the seal over a longer period of time and repeated uses. For an application such as storage of clothing, the user is likely to store garments for an extended period of time on the order of weeks or months. A seal that is not effective or that leaks over the course of hours or days is not useful in such an application.

Zipper seals are generally used in applications in which the tightness of the seal is not critical, such as in common household sandwich bags. More robust zipper seals exist, but are only used in very different applications. For example, U.S. Pat. No. 3,847,711 issued to Howard discloses a heat-sealing system for plastic containers in which the system is only designed for liquids, and gas pressures or vacuums are never contemplated. Also, the basic configuration of the bag is quite different, in that the fastener is along the side of a bag that is heated to seal the edges.

Therefore, there is a need for a reusable, evacuable storage container that may be conveniently used, closed and evacuated, and reused and that effectively maintains the sealed environment.

SUMMARY OF THE INVENTION

In accordance with the objects of the invention, the invention provides an evacuable, reusable container that is integral in design and that maintains an effective seal in order to preserve its contents. The seal may be a zipper seal that is sufficiently robust to maintain the integrity of the sealed environment in the bag for long periods of time.

The invention provides an evacuable storage container for holding compressible articles. The storage container comprises a flexible, air-impermeable bag defining an interior and having first and second openings, a one-way valve mechanism sealingly positioned over the first opening, and configured to allow fluid to pass through the valve mechanism out of the bag and to substantially prevent fluid from entering the bag, and a zipper seal adjacent the second opening that is configured to substantially close the second opening. The zipper seal is integral with the bag and comprises a first strip including at least one rib that extends from the surface of the first strip, and a second strip opposite the first strip. The second strip includes at least two ribs that extend from the surface of the second strip and that are offset from the rib of the first strip such that the first and second strips may be sealingly engaged.

Thee evacuable storage container may be configured such that the first and second strips define a surface interface, and the first and second strips are configured to fittingly mate together such that they are flush with the surface interface when they are engaged. This configuration of the first and second strips was found to be surprisingly effective in maintaining a vacuum within the container.

Preferably, the second strip includes one more rib than the first strip. In particular, the first strip comprises 2 ribs and the second strip comprises 3 ribs. More ribs may be added to further enhance sealing.

The ribs of the first and second strips may have respective head portions and neck portions, wherein the head portions are wider than the neck portions. Also, the heads portions may be arcuate in profile. Further, the base portions of adjoining neck portions may then form an arcuate profile. In this configuration, the profile of the head portions may fittingly mate the profile of the neck portions. Additionally, the ribs of the first strip may be substantially identical to each of the ribs of the second strip.

In manufacture of the container, the ends of the first and second strips may be joined by heat-crimping. This may enhance the sealing at the ends of the zipper seal. As another feature, the first and second strips may have a depression in respective outward sides that is aligned with a respective rib to enhance the bendability of the strips and thus enhance sealing.

Figure 1:
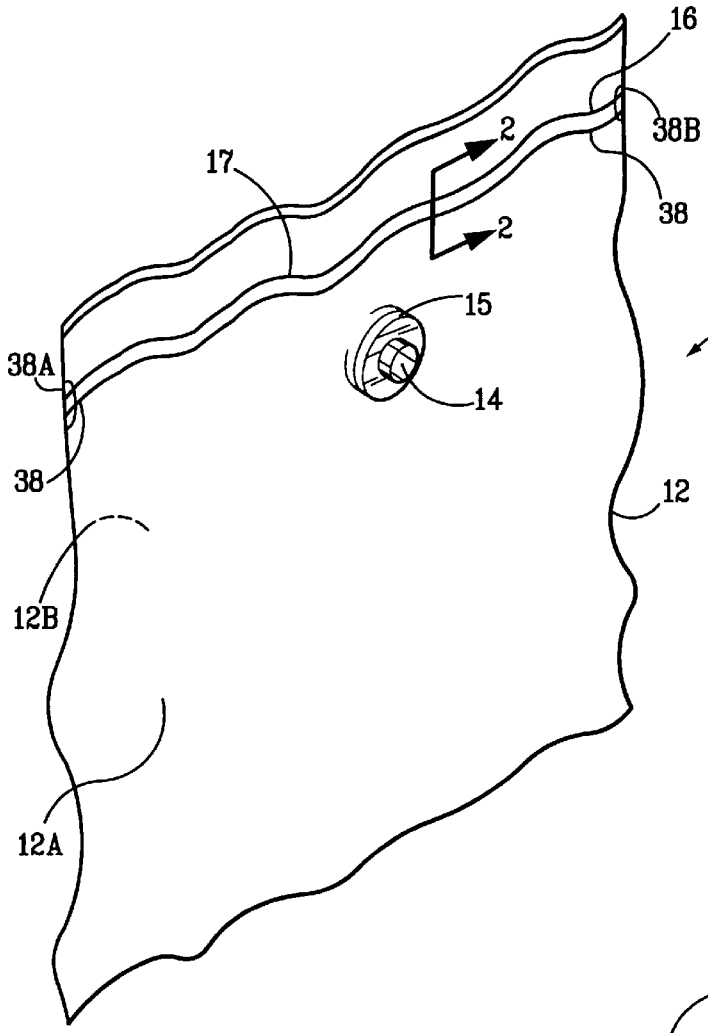
FIG. 1 is a perspective view of an evacuable collapsible container embodying the invention.

Before one embodiment of the invention is explained in detail, it is to be understood that the invention is not limited in its application to the details of the construction and the arrangements of processes set forth in the following description or illustrated in the drawings. The invention is capable of other embodiments and of being practiced or being carried out in various ways. Also, it is understood that the phraseology and terminology used herein is for the purpose of describing the illustrated embodiment and should not be regarded as limiting the scope of the invention.

DETAILED DESCRIPTION OF THE PREFERRED EMBODIMENT

FIG. 1 shows an evacuable storage container 10 embodying the present invention. The container 10 includes a flexible bag 12, a valve mechanism 14 and a zipper seal 16. The evacuable storage container 10 according to the present invention is particularly useful for holding compressible articles such as clothing. The container 10 may be quickly and easily evacuated to preserve the contents inside. Such a container not only is helpful in preserving the stored contents of the container, but also is useful in reducing the storage space of compressible articles.

The flexible bag 12 includes two openings. The valve mechanism 14 is mounted over the first opening 15. Valve mechanism 14 is a one way valve mechanism that may be used to remove the air from inside the flexible bag 12. The second opening 17 may be closed by means of the zipper seal 16. The zipper seal 16 is positioned adjacent to the second opening 17 and may be reusably opened and closed to seal the container 10 from the ambient air.

Though the invention is shown including a flexible bag 12, the invention may also be practiced using a container that is at least partially ridged. Removal of the air within the container would still help to preserve the contents inside. If a container is used that is entirely ridged, then a configuration of the invention may include a separate lid that engages a main portion of the container via a similar zipper seal.

In any configuration, the material of the container 10 should preferably be air impermeable, because the container is intended to be evacuated for relatively long periods of storage such as a month or more. Therefore, the material of the container, such as flexible bag 12 should be at least as air impermeable as the zipper seal 16. In prior art container designs, the effectiveness of the bag is limited not by the air impermeability of the flexible bag 12 itself, but by the security of the valve mechanism or the seal.

A variety of plastic materials may be used for the flexible bag 12 itself. Such materials are commonly known in prior art flexible bags and may be, for example, laminated films having high gas barrier qualities, and the like. One preferred embodiment is a laminate of low density polyethylene, nylon and a second layer of low density polyethylene, which facilitates sealing of first and second fastener strips 22 and 24 to the film, when they are made of polyethylene.

Valve mechanism 14 is a one way valve that allows the air to be quickly and easily evacuated from inside the container 10, yet maintains a vacuum within the bag 12 for a long period of time. In the preferred embodiment, the valve mechanism 14 is adapted to be attached to a common household vacuum cleaner. In this way, a commonly available means may be used to evacuate the air within the container 10. After the air within the bag has been vacuumed out, the valve mechanism 14 is closed and capped to maintain the integrity of the seal. Such a valve mechanism suitable for use in the present invention is shown and described in U.S. Pat. No. 5,480,030, issued Jan. 2, 1996 to Sweeney et al., herein incorporated by reference in its entirety.

Figure 2:
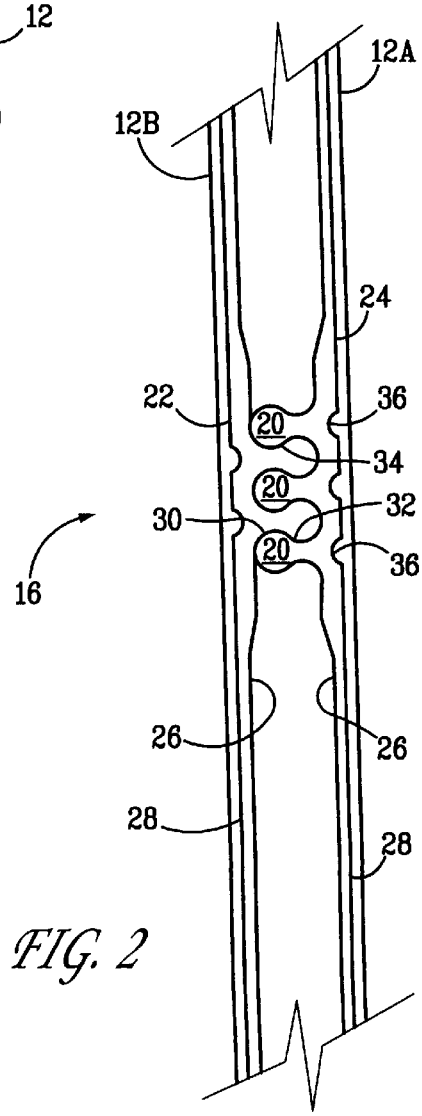
FIG. 2 is a cross-sectional view, along line 2—2 of FIG. 1, of the zipper seal of the container.

The zipper seal 16 of the container 10 is shown in cross sectional profile in FIG. 2. The zipper seal 16 of the present invention was found to be, in the disclosed configuration, particularly effective in maintaining the vacuum within container 10 over a long period of time. In tests, an evacuable storage container 10 having the zipper seal 16 of the present invention was found to maintain the vacuum for a period of about a month or more. Such a storage term is necessary for a container 10 similar to the present invention to be useful and effective in its typical application. This is because the typical consumer store articles such as clothing for a period of a month or more at a time. Therefore, a container 10 that is reusable, but does not maintain an effective vacuum over a period of time such as a month or more is not useful.

As shown in FIG. 2, the zipper seal 16, or vacuum fastener, includes a plurality of ribs 20 that interengage on each side of the zipper seal 16. The zipper seal 16 comprises a first strip 22 and a second strip 24 that are integral with the flexible bag 12 of FIG. 1. First strip 22 is either integral with or sealed to bag wall 12A. Second strip 24 is either integral with or sealed to bag wall 12B. The zipper seal 16 may be formed integrally, such as by extruding the zipper seal 16 in the same extrusion with the bag 12, or the zipper seal may be attached to the bag 12, such as by plastic welding. The material at the base of the first strip 22 and the second strip 24 is thicker than that of the surrounding flexible bag to enhance the rigidity at the zipper seal. In a preferred embodiment, the first strip 22 has first strip flanges 22A and 22B extending laterally therefrom, which are at least 7 thousandths of an inch thick. In the preferred embodiment the flanges are either thousandths of an inch thick at its end, increasing to fourteen thousandths, on the consumer side of the strip, and thirteen thousandths thick on the end of the product side flange increasing to fifteen thousandths near the profile. This increased thickness makes the fastener profiles more difficult to open from the product pushing against the interlocked profiles. These thick flanges provide sufficient material so that when sealed to bag 12, the flanges melt sufficiently to provide a gas barrier. Second strip 24 similarly has second strip flanges 24A and 24B extending laterally therefrom, which are also at least seven thousandths thick for sealing to provide a gas barrier. Both the first strip 22 and the second strip 24 have respective inward sides 26 and outward sides 28. The ribs 20 extend from the respective inward sides 26 of the first and second strips 22 and 24.

The zipper seal 16 is comprised of a plurality of ribs. In the illustrated embodiment, the first strip 22 is shown including two ribs and the second strip 24 is shown including three ribs. In the preferred embodiment the second strip includes one more rib than the first strip such that the ribs of the first strip 22 are completely interengaged, or captured, by the ribs of the second strip 24.

As shown in FIG. 2, each of the ribs has the same cross sectional profile. Each of the ribs generally includes a head portion 30 that is thicker than the neck portion 32. The head portion 30 is largely circular, or arcuate, in profile. The head portion 30 tapers to the neck portion 32. The neck portion 32 has a concave arcuate or circular profile. In this way, as shown in the figure, each rib 20 is designed to "fit" within the space between adjacent ribs of the opposite strip. Put another way, the ribs 20 of the first and second strips 22 and 24 define a surface interface 34 between the first and second strips 22 and 24, and the ribs 20 are flush with the surface interface 34. When the zipper seal 16 is engaged in this way, the ribs 20 of zipper seal 16 fittingly mate together and fill the space between the first and second strip 22 and 24.

Such a configuration has a number of benefits over prior art configurations in containers 10 of this type. First and foremost, such a zipper seal 16 forms a reusable seal that effectively maintains the vacuum in the bag over long periods of time. Second, the use of such a zipper seal that is integral to the container 10 and avoids the use of any external sealing means. Thus the container 10 has fewer parts and may be simpler or more economical to manufacture. Third, the design of the zipper seal 16 is easily scaleable to different configurations. For example, the number of ribs 20 may be increased to further the effectiveness of the seal 16. A number of depressions 36 are aligned with the ribs 20 on the opposite side of the respective first second strips 22 and 24. The depressions 36 are thus on the outward side 28 of the strips. To enhance sealing at the ends 38 (FIG. 1) of the zipper seal 16, the zipper seal 16 may be heat-crimped at the ends 38A and 38B.

The zipper seal of the invention has proven to be unexpectedly effective for maintaining an air tight seal. In tests, the illustrated zipper seal has substantially held a vacuum within the bag for time periods on the order of a month or more, and proved to be far superior to other commercially available products of this type.

While the several embodiments of the present invention has been shown and described, alternative embodiments will be apparent to those skilled in the art and are within the intended scope of the present invention. Therefore, the invention is to be limited only by the following claims:

We claim:

1. An evacuable storage container for holding compressible articles, said storage container comprising:

a flexible, air-impermeable bag defining an interior and having first and second openings, a first bag wall and a second bag wall;

a one-way valve mechanism capable of interfacing with a vacuum hose sealingly positioned over the first opening, and configured to allow fluid and air to pass through said valve mechanism out of said bag when said one-way valve is open and to substantially prevent fluid and air from entering said bag when said one-way valve is closed; and a zipper seal adjacent the second opening that is configured to substantially close the second opening, said zipper seal being integral with said bag and comprising:

a first strip attached to said first bag wall and including at least one rib that extends from the surface of said first strip; said first strip having first strip flanges extending laterally therefrom, which are at least seven thousandths of an inch thick, and eight thousandths of an inch thick at their ends, so that said flanges provide sufficient material that, when sealed to said bag wall, said flanges melt sufficiently to provide a gas barrier at the ends of, and along the length of, said first strip, without any intervening sealing material between said first strip flanges and said first bag wall, and a second strip opposite said first strip and attached to said second bag wall, said second strip including at least two ribs that extend from the surface of said second strip and that are offset from said rib of said first strip such that said first and second strips may be sealingly engaged and maintain an airtight seal when so engaged, said second strip having second strip flanges extending laterally therefrom which are at least seven thousandths of an inch thick and eight thousandths of an inch thick at their ends, so that when sealed to said bag wall, said flanges provide sufficient material that when sealed to said bag wall, said flanges melt sufficiently to provide a gas barrier at the ends of; and along the length of said second strip, without any intervening sealing material between said second strip flanges and said second bag wall, said thickness of said flanges when melted filling any gaps in said sealing at said ends of said zipper.

2. The evacuable storage container of claim 1, wherein said first and second strips define a surface interface, and wherein said first strip and said second strip are configured to fittingly mate together such that they are flush with the surface interface when they are engaged.

3. The evacuable storage container of claim 1, wherein said second strip includes one more rib than said first strip.

4. The evacuable storage container of claim 1, wherein said first strip comprises 2 ribs and said second strip comprises 3 ribs.

5. The evacuable storage container of claim 1, wherein said ribs of said first and second strips have respective head portions and neck portions, and wherein said head portions are wider than said neck portions.

6. The evacuable storage container of claim 1, wherein said ribs of said first and second strips have respective head portions and neck portions, and wherein said heads portions are arcuate in profile.

7. The evacuable storage container of claim 6, wherein said base portions of adjoining neck portions form an arcuate profile.

8. The evacuable storage container of claim 7, wherein the profile of said head portions fittingly mates the profile of said neck portions.

9. The evacuable storage container of claim 1, wherein each of said ribs of said first strip is substantially identical to each of said ribs of said second strip.

10. The evacuable storage container of claim 1, wherein said first strip has first and second ends, and wherein said second strip has a first and second ends, and wherein respective first ends and respective second ends of said first and second strips are joined by heat-crimping.

11. The evacuable storage container of claim 1, wherein said first and second strips have respective inward sides and outward sides, and wherein said ribs are disposed on the inward sides, and wherein said first and second strips have a depression in respective outward sides that is aligned with a respective rib.

12. The storage container of claim 1 wherein said first strip and said second strip are heat sealed to said first bag wall and said second bag wall, respectively.

13. The storage container of claim 12 wherein said first strip has first strip flanges extending laterally therefrom and said second strip has second strip flanges extending laterally therefrom, said first strip flanges and said second strip flanges being arranged for contact with said first bag wall and said second bag wall respectively and constructed for sealing to said first bag wall and said second bag wall and providing a gas barrier between said flange strips and said bag walls when sealed to said film.

14. A zipper seal for a resealable evacuable storage bag having first and second bag walls, said zipper seal comprising:

a first strip including at least two ribs that extend from the surface of said first strip; and a second strip opposite said first strip, said second strip including at least two ribs that extend from the surface of said second strip and that are offset from said rib of said first strip such that said first and second strips may be sealingly engaged, wherein said first and second strips define a surface interface, and wherein said first strip and said second strip are configured to fittingly mate together such that they are flush with the surface interface when they are engaged, said first and second strips being constructed and arranged to maintain an airtight seal when so engaged; said first strip having first strip flanges extending laterally therefrom, which are at least seven thousandths of an inch thick, and eight thousandths of an inch thick at their ends, so that said flanges provide sufficient material that, when sealed to said bag wall, said flanges melt sufficiently to provide a gas barrier at the ends of, and along the length of, said first strip without any intervening sealing material between said first strip flanges and said first bag wall, and said second strip has second strip flanges extending laterally therefrom, which are at least seven thousandths of an inch thick, and eight thousandths of an inch thick at its ends, so that said flanges provide sufficient material that when sealed to said bag wall said flanges melt sufficiently to provide a gas barrier at the ends of, and along the length of, said second strip, without any intervening sealing material between said second strip flanges and said second bag wall, said thickness of said flanges when melted filling any gaps in said sealing at said ends of said zipper, said first strip flanges and said second strip flanges being constructed for contact between said film and said first and second flanges and arranged for sealing to said film as to provide a gas barrier between said film and said first and second flanges when said first and second flanges are sealed to said film.

15. The zipper seal of claim 14, wherein said second strip includes one more rib than said first strip.

16. The zipper seal of claim 14, wherein said first strip comprises 2 ribs and said second strip comprises 3 ribs.

17. The zipper seal of claim 14, wherein said ribs of said first and second strips have respective head portions and neck portions, and wherein said head portions are wider than said neck portions.

18. The zipper seal of claim 14, wherein said ribs of said first and second strips have respective head portions and neck portions, and wherein said heads portions are arcuate in profile.

19. The zipper seal of claim 18, wherein said base portions of adjoining neck portions form an arcuate profile.

20. The zipper seal of claim 19, wherein the profile of said head portions fittingly mates the profile of said neck portions.

21. The zipper seal of claim 14, wherein each of said ribs of said first strip is substantially identical to each of said ribs of said second strip.

22. An evacuable storage container for holding compressible articles, said storage container comprising:

a flexible, air-impermeable bag defining an interior and having first and second openings, a first bag wall and a second bag wall;

a one-way valve mechanism sealingly positioned over the first opening, and configured to allow fluid to pass through said valve mechanism out of said bag and to substantially prevent fluid from entering the bag; and a zipper seal adjacent the second opening that is configured to substantially close the second opening, said zipper seal being integral with said bag and comprising a first strip attached to said first wall, said first strip including at least two rib that extends from the surface of said first strip; and a second strip opposite said first strip and attached to said second wall, said second strip including at least three ribs that extend from the surface of said second strip and that are offset from said rib of said first strip such that said first and second strips may be sealingly engaged, wherein said first and second strips define a surface interface, and wherein said first strip and said second strip are configured to fittingly mate together such that they are flush with the surface interface when they are engaged, and wherein said ribs of said first and second strips have respective head portions and neck portions, and wherein said head portions are wider than said neck portions, and wherein said ribs of said first and second strips have respective head portions and neck portions, and wherein said heads portions are arcuate in profile, and wherein said base portions of adjoining neck portions form an arcuate profile, and wherein the profile of said head portions fittingly mates the profile of said neck portions, said zipper seal being constructed and arranged to maintain an airtight seal when closed;

said first strip and said second strip being heat sealed to said first wall and said second wall, respectively, said first strip having first strip flanges extending laterally therefrom, which are at least seven thousandths of an inch thick, and eight thousandths of an inch thick at its ends, so that said flanges provide sufficient material that, when sealed to said bag wall, said flanges melt sufficiently to provide a gas barrier at the ends of, and along the length of, said first strip without any intervening sealing material between said first strip flanges and said first bag wall, and said second strip has second strip flanges extending laterally therefrom, which are at least seven thousandths of an inch thick and eight thousandths of an inch thick at its ends, so that when sealed to said bag wall, said flanges provide sufficient material that when sealed to said bag wall, said flanges melt sufficiently to provide a gas barrier at the ends of, and along the length of, said second strip said first strip flanges and said second strip flanges being arranged for contact with said film and constructed for sealing to said film and providing a gas barrier between said flanges and said film when sealed to said film, without any intervening sealing material between said second strip flanges and said second bag wall, said thickness of said flanges when melted filling any gaps in said sealing at said ends of said zipper.

* * * * *